US005321958A

United States Patent [19]

Kim

[11] Patent Number: 5,321,958

[45] Date of Patent: Jun. 21, 1994

[54] SMALL-SIZED REFRIGERATOR

[75] Inventor: Seok R. Kim, Seoul, Rep. of Korea

[73] Assignee: Gold Star Co., Ltd., Seoul, Rep. of Korea

[21] Appl. No.: 980,473

[22] Filed: Nov. 23, 1992

[30] Foreign Application Priority Data

Dec. 2, 1991 [KR] Rep. of Korea ..... 21963/1991

[51] Int. Cl.[5] ..... F25D 21/00

[52] U.S. Cl. ..... 62/272; 62/132; 62/440; 62/452

[58] Field of Search ..... 62/132, 440, 441, 443, 62/445, 448, 449, 452, 465, 272, 281, 285, 288, 291

[56] References Cited

U.S. PATENT DOCUMENTS 3,280,583 10/1966 Jones et al. ..... 62/285

*Primary Examiner*—John M. Sollecito

*Attorney, Agent, or Firm*—John P. White

[57] ABSTRACT

This invention relates to a small-sized refrigerator comprising an evaporator being of a plate shape to provide an increased cold air producing area, and a defrosted water drain pan formed with a plurality of cold air passage openings to allow smooth convention of cold air in a refrigerating chamber, thereby enabling a proper temperature in the chamber to be achieved promptly and the temperature differences between the respective areas of the chamber to be minimized. To this end, the evaporator of a plate shape is mounted horizontally at the upper portion of the refrigerating chamber, and the defrosted water drain pan having a plurality of the cold air passage openings, overflow prevention walls and guide members for preventing defrosted water from passing through the openings is detachably disposed below the evaporator to collect the defrosted water dropping from the evaporator.

13 Claims, 6 Drawing Sheets

SMALL-SIZED REFRIGERATOR

BACKGROUND OF THE INVENTION

1. Field of the Invention

This invention relates to a small-sized refrigerator, and more particularly a small-sized refrigerator having improved evaporator and defrosted water drain pan to allow smooth convection of cold air produced at the evaporator, resulting in more uniform distribution of a temperature in a refrigerating chamber and a reduction in power consumption.

2. Description of the Prior Art

Generally, a small-sized refrigerator does not comprise divided freezing and refrigerating chambers, but only a refrigerating chamber, in which there are provided an evaporator and a defrosted water drain pan disposed below the evaporator to receive defrosted water dropping thereform.

Such a small-sized refrigerator according to the prior art comprises, as shown in FIGS. 1 to 4 of the accompanying drawings, a body 21 having a refrigerating chamber 22 provided therein, an evaporator 23 disposed at the upper side of the refrigerating chamber, a defrosted water drain pan 24 of a tray shape mounted below the evaporator to prevent the defrosted water from dropping to the lower portion of the chamber, a plurality of vertically spaced shelves 25 disposed transversely below the drain pan to support foodstuffs, a door 26 mounted in the front of the body 21 to prevent the cold air in the refrigerating chamber from flowing out, a compressor 27 disposed outside of the lower portion of the body to feed a refrigerant to the evaporator 23, and a temperature sensor (including a temperature control function) 28 mounted in the refrigerating chamber to turn on and off the compressor 27 depending upon the temperature in the chamber.

With this construction, the foodstuffs put on the shelves 25 in the refrigerating chamber 22 can be refrigerated and freshly preserved by cold air circulating in the chamber through a natural convection phenomenon. The cold air is produced by the action of the refrigerant compressed by the energized compressor 27 and introduced into the evaporator 23, and distributed in the chamber through the natural convection. At this time, when the temperature in the refrigerating chamber drops below a set temperature, the temperature sensor 28 disposed in the chamber detects it and stops the operation of the compressor 27. Thereafter, when the temperature rises again above the set temperature, the operation of the compressor is resumed through the sensing operation of the temperature sensor.

The foregoing describes one cycle of the operation of the refrigerator. Therefore, as long as the electric power is supplied to the refrigerator, "ON" and "OFF" of the compressor 27 is continually repeated in response to the sensing operation of the temperature sensor 28 depending upon temperature variations from the set temperature.

During the operation of the refrigerator, ice is usually formed on the outer surface of the evaporator 23 due to the cold air flow produced around the evaporator. With continued use of the refrigerator, the ice is excessively formed on the evaporator, to thereby reduce the refrigerating capacity of the refrigerator, so that there is a need to melt the ice by temporarily turning off the refrigerator. Therefore, in order to prevent the water produced by the deicing operation from dropping downwardly to the lower portion of the refrigerating chamber, the defrosted water drain pan 24 is usually mounted below the evaporator 23.

This prior small-sized refrigerator however has a drawback in that since the evaporator 23 for producing the cold air is of a L-shape and secured to the body 21 by means of fastening members 29 provided on the interior of the body, as shown in FIGS. 1 and 3, a cold air producing area is restricted to one side of the refrigerating chamber 22, so that there is a very excessive temperature difference between the side of the evaporator 23 and the area opposite to the side. Further, in the prior refrigerator, since the naturally convective flow of the cold air originating from the evaporator is intercepted by the defrosted water drain pan 24 disposed below the evaporator and passes through only the gap between the body 21 and the drain pan, smooth convection of the cold air may not be achieved and a long operating time of the compressor 27 is required to maintain the average temperature (usually 3° C.) in the refrigerating chamber, so that power consumption is increased.

SUMMARY OF THE INVENTION

With the foregoing drawbacks of the prior art in view, it is an object of the present invention to provide a small-sized refrigerator comprising an evaporator being of a plate shape to provide an increased cold air producing area, and a defrosted water drain pan formed with cold air passage openings to allow smooth convection of the cold air in a refrigerating chamber, thereby enabling the temperature in the refrigerating chamber to drop promptly to a set temperature and temperature differences between the respective areas of the chamber to be minimized.

To achieve the above object, there is provided according to the present invention a small-sized refrigerator comprising an evaporator of a plate shape mounted horizontally in a refrigerating chamber by means of an engaging protrusion formed on one side of a temperature sensor disposed at one side of the upper portion of the chamber, and a fastening member formed integrally with a body of the refrigerator at the opposite side of the chamber; and a defrosted water drain pan disposed below the evaporator and having a plurality of cold air passage openings formed therein to allow a smooth flow of cold air produced at the evaporator.

DESCRIPTION OF THE PREFERRED EMBODIMENT

Figure 1:
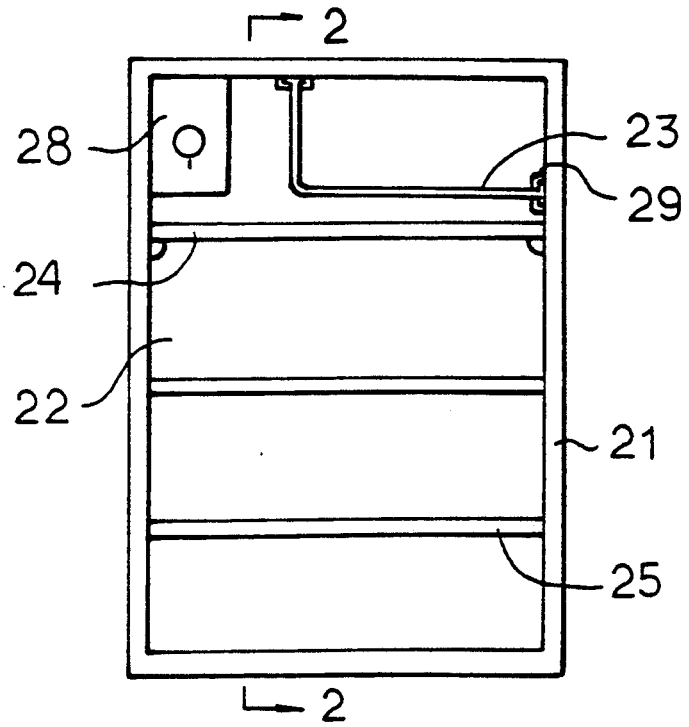
FIG. 1 PRIOR ART
FIG. 1 is a schematic view illustrating the structure of the essential parts of a prior are small-sized refrigerator.
Figure 2:
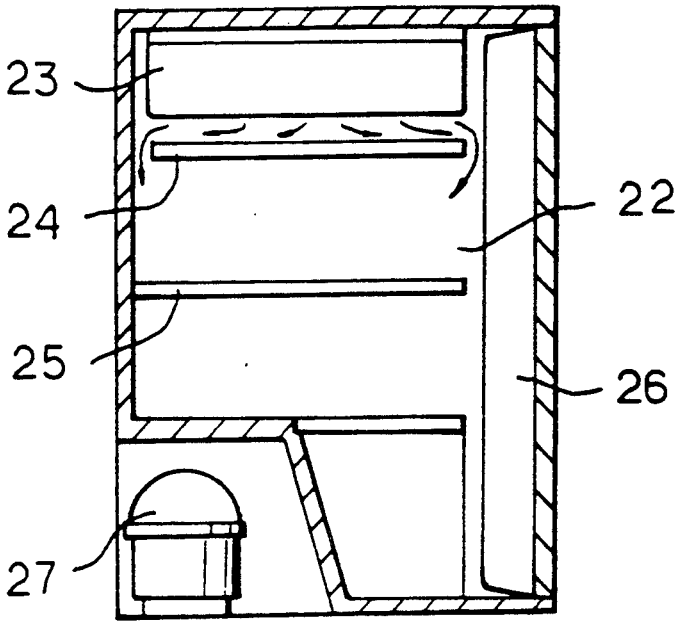
FIG. 2 PRIOR ART
FIG. 2 is a cross-sectional view taken along line 2—2 of FIG. 1.
Figure 3:
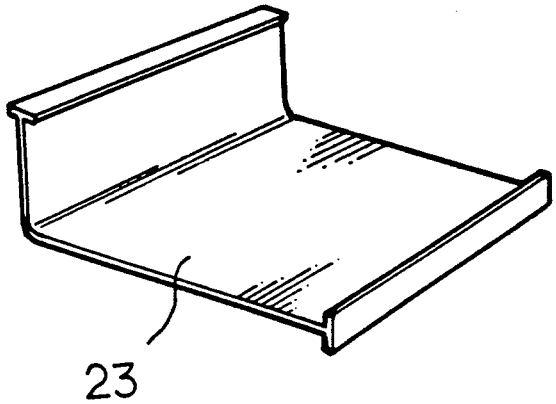
FIG.3 PRIOR ART
FIG. 3 is a perspective view of an evaporator used in the small-sized refrigerator of the prior art.
Figure 4:
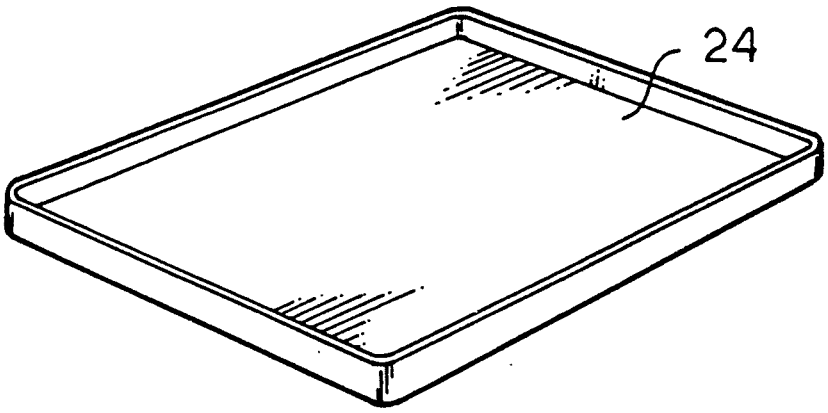
FIG.4 PRIOR ART
FIG. 4 is a perspective view of a defrosted water drain pan used in the prior art refrigerator.

The invention will now be described in more detail, by way of example, with reference to FIGS. 5 to 11 of the accompanying drawings.

The small-sized refrigerator of the present invention broadly comprises a body 1, a refrigerating chamber 2, an evaporator 3, a defrosted water drain pan 4, shelves 5, a door 6, a temperature sensor 7 and a compressor (not shown), similarly to a small-sized refrigerator of the prior art. The present invention resides in the improvements of the evaporator and the defrosted water drain pan. Therefore, the construction of the present invention will be described below in reference to the evaporator 3 and the defrosted water drain pan 4, and throughout the following description similar reference numerals refer to similar elements.

Figure 5:
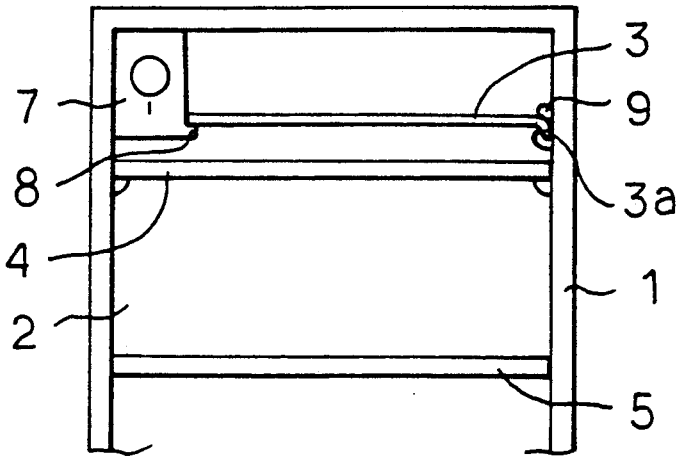
FIG. 5 is a schematic view illustrating the structure of the essential parts of the small-sized refrigerator according to the present invention.
Figure 6:
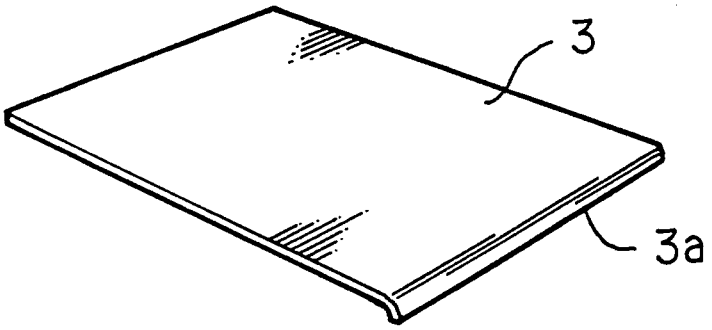
FIG. 6 is a perspective view of an evaporator used in the refrigerator of the present invention.
Figure 7:
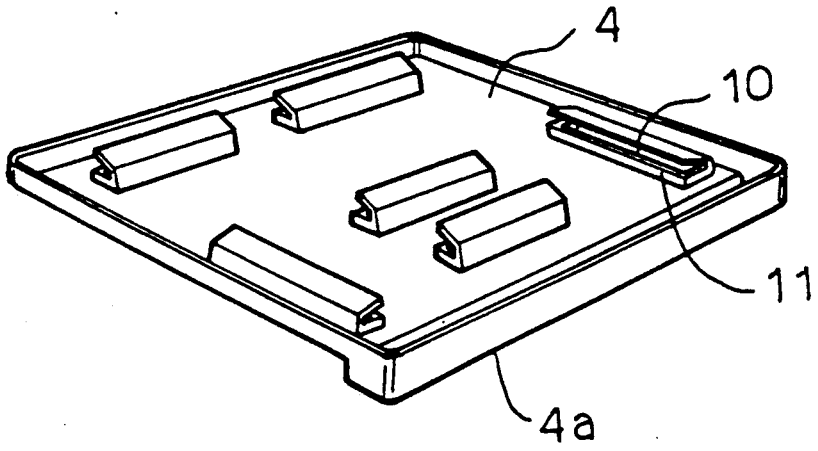
FIG. 7 is a perspective view of one embodiment of a defrosted water drain pan used in the refrigerator of the present invention.
Figure 8:
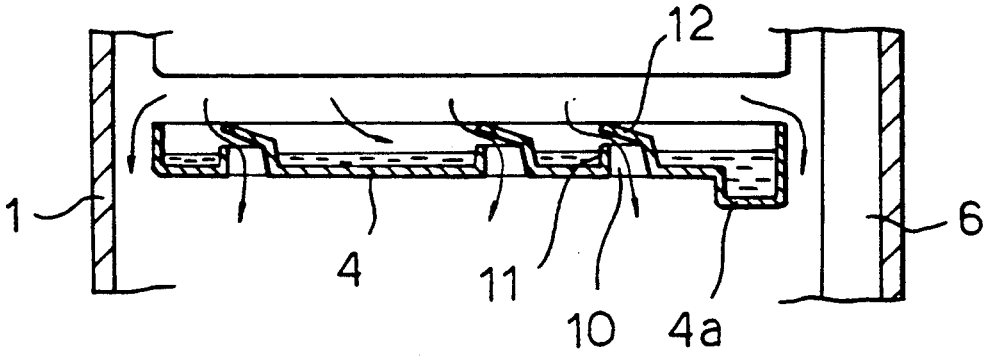
FIG. 8 is a cross-sectional view of the drain pan of FIG. 7 in use state.

Reference is first made to FIGS. 5 to 8. FIG. 5 shows a schematic view of the structure of the essential parts of the small-sized refrigerator of the present invention; FIG. 6 shows the evaporator used in the refrigerator of FIG. 5; FIG. 7 shows the defrosted water drain pan of one embodiment used in the refrigerator of the present invention; and FIG. 8 shows in section the drain pan of FIG. 7 in the use state.

According to the present invention, the evaporator 3 is of a plate shape and mounted horizontally in the refrigerating chamber 2 by means of an engaging protrusion 8 formed on the lower end of one side of the temperature sensor 7, which is disposed at one side of the upper portion of the refrigerating chamber to control the temperature in the chamber, and a fastening member 9 formed integrally with the body 1 at the opposite side of the refrigerating chamber. Preferably, the evaporator 3 is formed one side with a bent portion 3a, which is engaged with the fastening member 9 to prevent playing of the mounted evaporator.

The defrosted water drain pan 4 detachably disposed below the evaporator 3 to receive the defrosted water dropping from the evaporator comprises a plurality of cold air passage openings 10 through which the cold air may pass, overflow prevention walls 11 formed along the periphery of each of the openings 10 to prevent the collected water in the drain pan from entering the openings, and inclined guide members 12 each connected on one side to one of the overflow prevention walls 11 with a predetermined degree of inclination to prevent the water dropping from the evaporator 3 to the cold air passage openings from passing downwardly through the openings. Each guide member 12 is arranged such that clearances for allowing cold air flow communication are defined between its free sides and the overflow prevention walls.

Further, the defrosted water drain pan 4 has a collection recess 4a formed at its front portion so as to store the defrosted water. Since the collection recess 4a is formed to protrude downwardly, it also serves as a handle when the drain pan is taken out of the refrigerator.

The cold air is produced by the action of the refrigerant compressed in the compressor and passing through the evaporator 3 in a conventional manner. In the present invention, since the evaporator is of a plate shape and mounted horizontally by means of the engaging protrusion 8 of the temperature sensor 7 disposed at one side of the upper portion of the refrigerating chamber 2, and the fastening member 9 formed integrally with the body 1, as shown in FIG. 5, an increased cold air producing area is provided, thereby enhancing the refrigerating capacity and greatly reducing the temperature variation at the upper portion of the refrigerating chamber. Furthermore, since the cold air produced at the evaporator and circulating in the refrigerating chamber through the natural convection may pass through the cold air passage openings 10 formed in the defrosted water drain pan 4, smooth circulation of the cold air may be achieved.

The function of the defrosted water drain pan 4 disposed below the evaporator 3 is to prevent the defrosted water dropping from the evaporator during operation of the refrigerator from falling to the lower portion of the refrigerating chamber. Therefore, the water dropping from the evaporator remains collected in the drain pan without entering the cold air passage openings 10 by virtue of the overflow prevention walls 11 formed around the openings. The water drips dropping directly toward the openings 10 are intercepted by the guide members 12 formed integrally with one of the overflow prevention walls 11 to cover the openings, and then flow down guided by the inclined guide members 12 to be collected in the drain pan 4 without falling to the lower portion of the refrigerating chamber through the openings.

When the drain pan 4 has been filled with the defrosted water up to a predetermined level, i.e., to the extent that the water does not overflow the overflow prevention walls 11 of the cold air passage openings 10, the drain pan may be removed from the refrigerating chamber 2 to empty out the water from the pan, and then put again in the chamber.

As discussed above, since the evaporator 3 has an increased cold air producing area and the cold air produced at the evaporator may smoothly circulate in the refrigerating chamber through the cold air passage openings 10 of the defrosted water drain pan 4, the temperature differences between the respective areas of the chamber may be minimized and the average temperature in the chamber may be achieved and maintained in a short time. As a result, an operating rate of the compressor may be lowered, thereby reducing power consumption.

Figure 9:
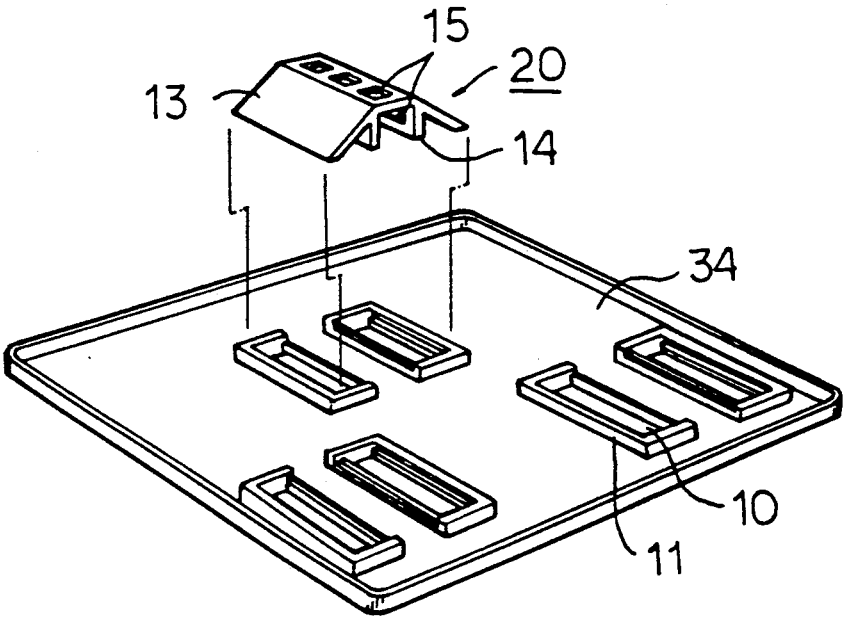
FIG. 9 is a perspective view of another embodiment of the defrosted water drain pan used in the refrigerator of the present invention.
Figure 10:
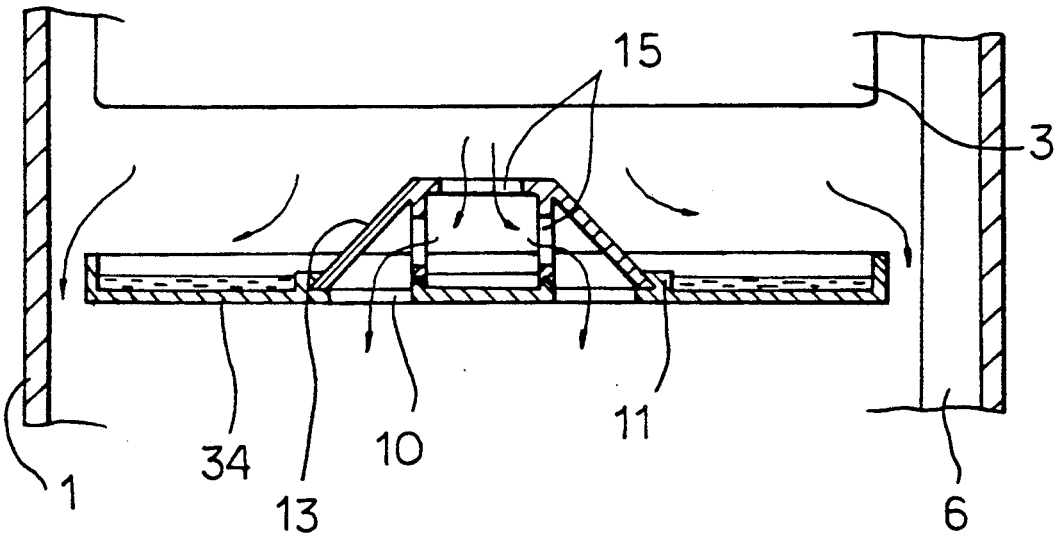
FIG. 10 is a cross-sectional view of the drain pan of FIG. 9 in the use state.

FIG. 9 and 10 show another embodiment of the defrosted water drain pan used in the refrigerator of the present invention. The defrosted water drain pan 34 of this embodiment has a plurality of cold air passage openings 10 formed in pairs and a plurality of defrosted water drip intercepting members 20 detachably disposed thereon one for a pair of the cold air passage openings 10. Each of the defrosted water drip intercepting members 20 comprises a wing plate 13 of a roof shape having a pair of inclined portions and a central plane portion between the inclined portions, a pair of supports 14 depending downwardly from the lower surface of the central portion of the wing plate 13, and a plurality of through holes 15 formed in the central portion of the wing plate 13 and the supports 14.

With this construction, the cold air produced at the evaporator 3 passes through the through holes 15 of the defrosted water drip intercepting members 20 and the cold air passage openings 10 of the defrosted water drain pan 34, thereby smoothly circulating in the refrigerating chamber, while the defrosted water dropping from the evaporator is collected in the defrosted water drain pan 34. At this time, the water drips dropping directly to the cold air passage openings 10 flow down guided by the inclined portions of the wing plate 13, and then are collected in the drain pan 34. This embodiment also has the same effects as those of the previous embodiment.

Figure 11:
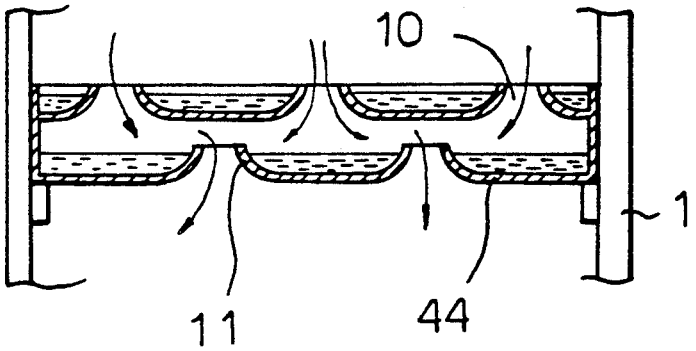
FIG. 11 is a cross-sectional view of still another embodiment of the defrosted water drain pan used in the refrigerator of the present invention.

FIG. 11 shows in section still another embodiment of the defrosted water drain pan mounted in the refrigerator of the present invention. The drain pan 44 of this embodiment comprises a hollow container having closed sides and upper and lower plates formed with a plurality of cold air passage openings 10. The openings are arranged such that the openings of the upper plate come out of registry with those of the lower plate. With this arrangement, the defrosted water produced at the evaporator 3 passes through the cold air passage openings of the upper and lower plates of the defrosted water drain pan 44 in the direction shown by the arrows, thereby smoothly circulating in the refrigerating chamber, while the water dropping from the evaporator is collected in the upper plate of the drain pan 44. The water drips falling directly to the cold air passage openings 10 of the upper plate of the drain pan are collected on the lower plate of the drain pan. When the upper plate is full of the water overflowing water falls through the openings 10 of the upper plate to the lower plate of the drain pan 44 to be collected thereon. This embodiment also has the same effects as those of the embodiments described above.

Figure 12:
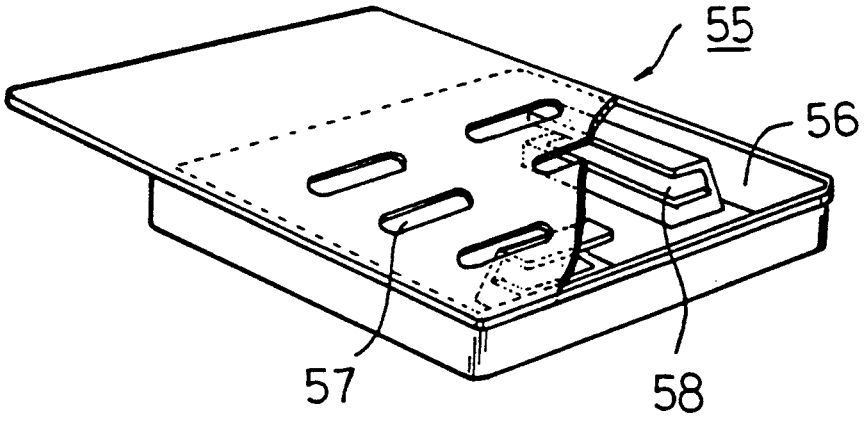
FIG. 12 is a perspective view showing an improved shelf used in the refrigerator of the present invention.

FIG. 12 shows an improved shelf according to another feature of the present invention. The shelf 55 comprises a water drip tray portion 56 provided at its front portion. The drip tray portion is of a hollow container shape and includes an upper plate being a part of the main plate of the shelf and formed with a plurality of through holes 57 through which the cold air and the water drips may pass, and a lower plate serving as a drip tray and provided with a plurality of cold air passages 58 which are formed in registry with the holes of the upper plate. The lower plate is narrower in width than the upper plate such that the drip tray portion has flanges by which the shelf may be supported on the inner walls of the body of the refrigerator. Each cold air passage 58 of the lower plate comprises an opening through which the cold air may pass, overflow prevention walls formed along the periphery of the opening and an inclined guide member, which are similar to the cold air passage opening 10, the overflow prevention walls 11 and the guide member 12 of the defrosted water drain pan 4 shown in FIG. 7, respectively. This shelf acts to allow the smooth convection of the cold air, while preventing the water drips from dropping to the lower portion of the refrigerating chamber.

While the invention has been shown and described with particular reference to various embodiments thereof, it will be understood that variations and modifications in form and detail may be made therein without departing from the spirit and scope of the invention defined in the appended claims.

What is claimed is:

1. A small sized refrigerator comprising:

an evaporator mounted horizontally at the upper portion of a refrigerating chamber for producing cold air;

a defrosted water drain pan disposed below said evaporator for collecting defrosted water dropping from said evaporator, said defrost water drain pan comprising a plurality of air passage means for allowing said cold air to pass through said defrosted water drain pan within said refrigerating chamber;

shelves disposed below said drain pan for supporting foodstuffs;

temperature sensing means for sensing a temperature in said refrigerating chamber; and a door.

2. A small-sized refrigerator as claimed in claim 1, in which said evaporator is mounted by means of an engaging protrusion formed on the lower end of one side of said temperature sensing means, and a fastening member provided on the side of said refrigerating chamber opposite to said temperature sensing means.

3. A small-sized refrigerator as claimed in claim 1, in which said defrosted water drain pan comprises:

a plate member for collecting the defrosted water dropping from said evaporator;

a plurality of cold air passage means formed in pairs in said plate member to permit the cold air originating from said evaporator to be circulated in said refrigerating chamber through them;

guide means formed integrally with said plate member to prevent the collected water on said plate member from entering said cold air passage means; and a plurality of defrosted water drip interception means disposed above said cold air passage means, one for a pair of the passage means, to prevent the defrosted water dropping from said evaporator from falling directly to the lower portion of said chamber through said cold air passage means.

4. A small-sized refrigerator as claimed in claim 3, in which each of said defrosted water drip intercepting means comprises:

a wing member for preventing the defrosted water from falling directly to the lower portion of said chamber through a pair of said cold air passage means;

through holes formed in the central portion of said wing member; and support members provided at the underside of said wing member and detachably engaged with said guide means.

5. A small-sized refrigerator as claimed in claim 1, in which said defrosted water drain pan comprises:

a first plate member for collecting the defrosted water dropping from said evaporator;

a second plate member disposed below said first plate member to collect the overflowing water dropping from said first plate member; and cold air passage means formed in said first and second plate members to permit the cold air originating from said evaporator to be circulated in said chamber through them.

6. A small-sized refrigerator as claimed in claim 5, in which said cold air passage means are arranged such that the cold air passage means of said first plate member come out of registry with those of said second plate member.

7. A small-sized refrigerator as claimed in claim 1, in which each of said shelves comprises a panel having a plurality of first cold air passage means formed therein to allow smooth convection of the cold air; and a drip tray disposed below said panel to collect the water dropping from said panel and formed with a plurality of second cold air passage means for permitting the cold air to be circulated in said refrigerating chamber through them.

8. A small-sized refrigerator as claimed in claim 7, in which said drip tray comprises a plate member disposed below a portion of the shelf; and guide members provided on said plate member to prevent the collected water on said plate member from falling down through said second cold air passage means.

9. A small-sized refrigerator as claimed in claim 8, in which said drip tray further comprises second guide members provided to prevent the water dropping from said first cold air passage means of said panel from falling down directly through said second cold air passage means.

10. A small sized refrigerator comprising:

an evaporator for producing cold air in a refrigerating chamber;

a defrosted water drain pan disposed below said evaporator for collecting defrosted water dropping from said evaporator, while allowing said cold air to pass therethrough into said refrigerating chamber;

shelves disposed below said drain pan for supporting foodstuffs;

temperature sensing means for sensing a temperature in said refrigerating chamber; and a door;

said evaporator mounted horizontally at the upper portion of said refrigerating chamber by means of an engaging protrusion formed on the lower end of one side of said temperature sensing means and a fastening member provided on the side of said refrigerating chamber opposite to said temperature sensing means.

11. A small-sized refrigerator as claimed in claim 10, in which said evaporator is formed one side with a bent portion, which is engaged with said fastening member to prevent playing of the mounted evaporator.

12. A small-sized refrigerator as claimed in claim 10, in which said defrosted water drain pan comprises a plate member for collecting the defrosted water dropping from said evaporator;

a plurality of cold air passage means formed in said plate member to permit the cold air originating from said evaporator to be circulated in said refrigerating chamber through them;

first guide means provided on said plate member to prevent the defrosted water dropping from said evaporator from falling directly to the lower portion of said chamber through said cold air passage means; and second guide means provided on said plate member to prevent the water collected on said plate member from entering said cold air passage means.

13. A small-sized refrigerator as claimed in claim 12, in which said plate member comprises storage means for storing the defrosted water collected on said plate member, the storage means also serving as a handle facilitating mounting and removal of said drain pan.

* * * * *